US005189845A

United States Patent [19]

Courchesne

[11] Patent Number: 5,189,845

[45] Date of Patent: Mar. 2, 1993

[54] BLADE SHARPENING DEVICE AND METHOD

[76] Inventor: Richard L. Courchesne, 3931 Sherwood Blvd., Delray Beach, Fla. 33445

[21] Appl. No.: 856,516

[22] Filed: Mar. 24, 1992

Related U.S. Application Data

[63] Continuation-in-part of Ser. No. 538,542, Jun. 14, 1990, Pat. No. 5,103,597.

[51] Int. Cl.[5] ..... B21K 17/00

[52] U.S. Cl. ..... 51/205 R; 51/205 WG; 51/211 R; 51/214; 76/83; 76/88

[58] Field of Search ..... 51/173, 181 R, 204, 51/205 R, 205 WG, 211 R, 211 H, 214, 228; 76/83, 85–86, 88

[56] References Cited

U.S. PATENT DOCUMENTS

| | | | |
|---|---|---|---|
| 1,006,000 | 10/1911 | Oosdyke | 51/205 WG |
| 1,335,813 | 4/1920 | Berghman | 51/205 WG |
| 2,042,916 | 6/1936 | Vlozzi | 51/205 WG |
| 3,841,030 | 10/1974 | Laszlo | 51/170 PT |
| 5,103,597 | 4/1992 | Courchesne | 51/205 R |

FOREIGN PATENT DOCUMENTS

| | | | |
|---|---|---|---|
| 668293 | 8/1963 | Canada | 51/205 WG |
| 2613985 | 10/1977 | Fed. Rep. of Germany | 51/228 |

*Primary Examiner*—Bruce M. Kisliuk
*Assistant Examiner*—John A. Marlott
*Attorney, Agent, or Firm*—Jack E. Dominik

[57] ABSTRACT

A blade sharpener which has two elements, one of which is a hand-held member, and the other of which is a follower member secured in the hand-held member is disclosed. The two members are pivotally secured each to the other, and secured at variable pre-selected pivot points so that adjustments can be made for the particular skate, and for the particular cross-section of the blade desired at various points along the power toe section, neutral underfoot section, or turning heel section. Means are provided interiorly of the single hand-held member to optionally secure a file of the varying cross-section. Guide means are supplied on the hand-held member to secure the relationship of the abrading member to the intended blade in a pre-selected centralized orientation. The guide means can be varied in their special relationship to accommodate varying thicknesses of blades. The method of the invention contemplates sharpening a blade by longitudinally stroking the same with a single file having a pre-selected cross-section and which is guided in a fixed relationship to the blade by a single adjustable pivot member to thereby develop the desired cross-section or cut of the blade at various points along its length.

5 Claims, 2 Drawing Sheets

BLADE SHARPENING DEVICE AND METHOD

CROSS-REFERENCED TO RELATED APPLICATION

The present application is a continuation-in-part of application Ser. No. 538,542, filed Jun. 14, 1990 and entitled "Blade Sharpening Device and Method", now U.S. Pat. No. 5,103,597.

FIELD OF THE INVENTION

The present invention is directed to a device and method for sharpening blades. It has particular utility in the sharpening of blades for use on hockey skates, but is also applicable for other type ice skating blades and blades such as those for ice boats, bobsleds, and the like.

SUMMARY OF THE PRIOR ART

Most techniques for sharpening blades involve a grinding wheel of some sort. Such grinding wheels are made up of fine particles of corundum bonded and pressed together with a grinding profile of the desired blade cut. In certain instances, a jig is employed, and the blade is moved coaxially with the axis of the blade. While this imparts a curved or slightly undercut configuration to the blade, it is generally uniform throughout the entire length of the blade. In this context, it is highly desirable to develop a blade sharpening apparatus and method which moves longitudinally of the blade, and which can be adapted to develop different depth and different profile cuts along the length of the blade including the power toe section, the neutral under foot section, and the turning heel section. In addition, it is highly desirable to stroke the blade longitudinally so that whatever roughness, scarifying, or striations result they are parallel with the path of the blade and therefore will be of minimal resistance as the blade crosses the ice. Previously the applicant has prepared and filed a patent application directed to a two piece device for sharpening blades. While the same has excellent utility and produces excellent results, there are those who would like a simpler unit of one piece and which can be easily adaptable to racing skates, figure skates, and other skates in addition to hockey skates and which also can accommodate varying blade widths. The following prior art is also considered relevant: U.S. Pat. No. 555,974 issued March, 1986; U.S. Pat. No. 1,828,870 issued August, 1931; U.S. Pat. No. 4,875,240 issued March, 1989; U.S. Pat. No. 471,164 issued March, 1892; U.S. Pat. No. 4,777,770 issued October, 1988; U.S. Pat. No. 1,324,512 issued December, 1919; and U.S. Pat. No. 1,006,000 issued October, 1911.

SUMMARY OF THE INVENTION

The present invention involves a blade sharpener which has two elements, one of which is a hand-held member, and the other of which is a follower member secured in the hand-held member. The two members are pivotally secured each to the other, and secured at variable pre-selected pivot points so that adjustments can be made for the particular skate, and for the particular cross-section of the blade desired at various points along the power toe section, neutral underfoot section, or turning heel section. Means are provided interiorly of the single hand-held member to optionally secure a file of the varying cross-section. Guide means are supplied on the hand-held member to secure the relationship of the abrading member to the intended blade in a pre-selected centralized orientation. The guide means can be varied in their spacial relationship to accommodate varying thicknesses of blades. The method of the invention contemplates sharpening a blade by longitudinally stroking the same with a single file having a pre-selected cross-section and which is guided in a fixed relationship to the blade by a single adjustable pivot member to thereby develop the desired cross-section or cut of the blade at various points along its length.

In view of the foregoing, the primary object of the present invention is to provide a means and method for sharpening blades which utilizes a single hand-held member to the end that the skater can use one hand to move the device back and forth, and the other hand to hold the skate.

Related objects include providing means in the sharpener whereby abrading members of varying cross-sections can be employed, and similarly, the space between the guides varied in order to accommodate blades of differing thicknesses.

A related and also important object of the present invention is to provide an apparatus for sharpening blades which will achieve the above objectives and which is inherently economical to build, of essentially one-piece unitary structure, and which will permit a method of sharpening which insures a good edge on the blade.

BRIEF DESCRIPTION OF THE ILLUSTRATIVE DRAWINGS

Further objects and advantages of the present invention will become apparent as the following description of an illustrative embodiment and method proceeds, taken in conjunction with the accompanying drawings, in which.

Figures 1, 2, 3, 4, 5, 6:
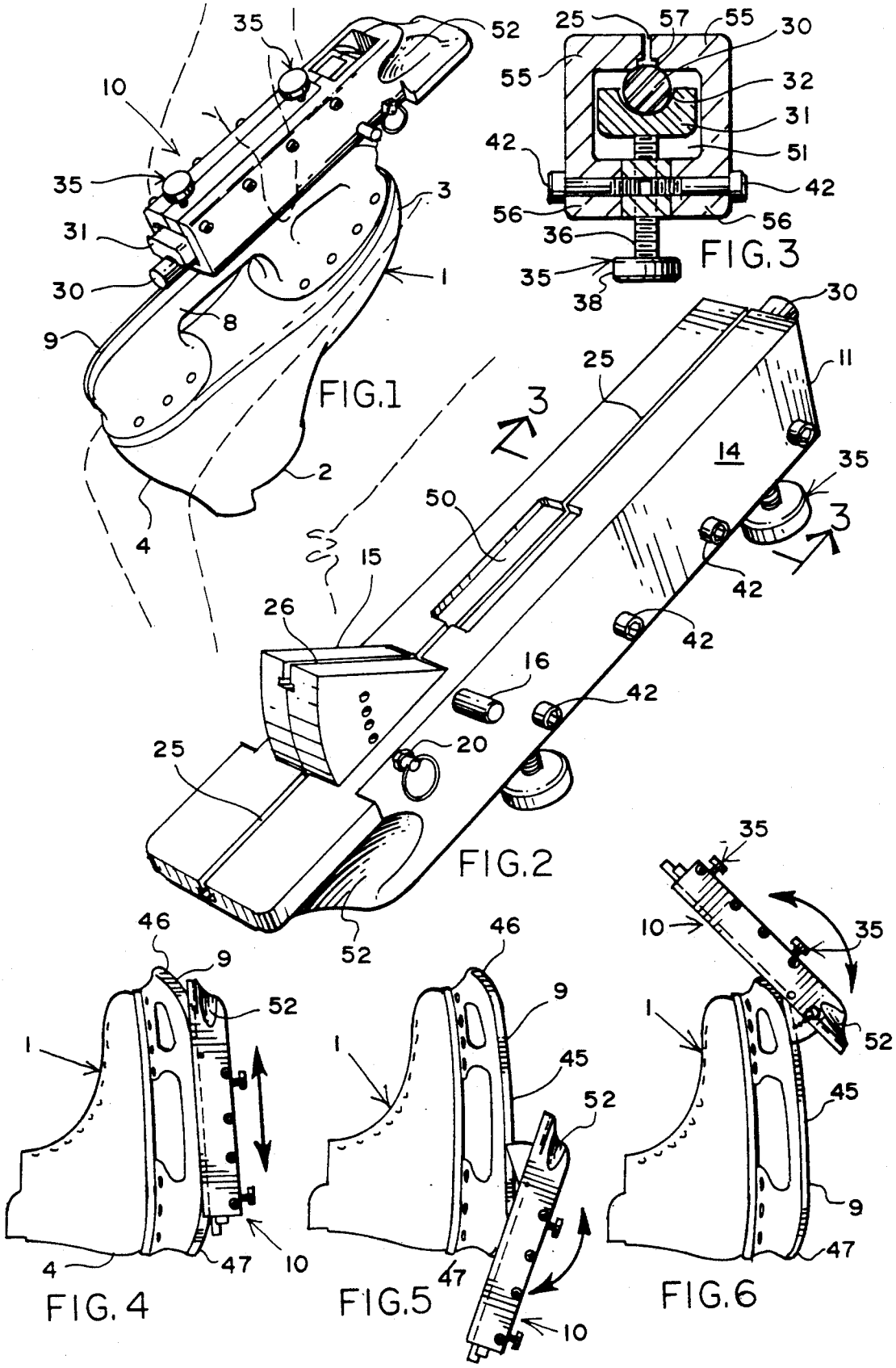
FIG. 1 is a perspective view of a typical ice skate of the hockey variety showing the hand of the user secured to the sharpener on the hand-held member, and showing how the blade is stroked along the hand-held member to form the desired cross-section.
FIG. 2 is a perspective view of the single hand-held member showing the pivotal guide in a partially raised position.
FIG. 3 is a transverse sectional view taken through a mid-portion of the hand-held member along 3—3 of FIG. 2 disclosing the widened entry/orientation slot forward of the pivotal element.
FIGS. 4, 5 and 6 show diagrammatically how the follower, at different orientations on its rotation, direct the angularity of presentation with the abrading member.
Figure 7:
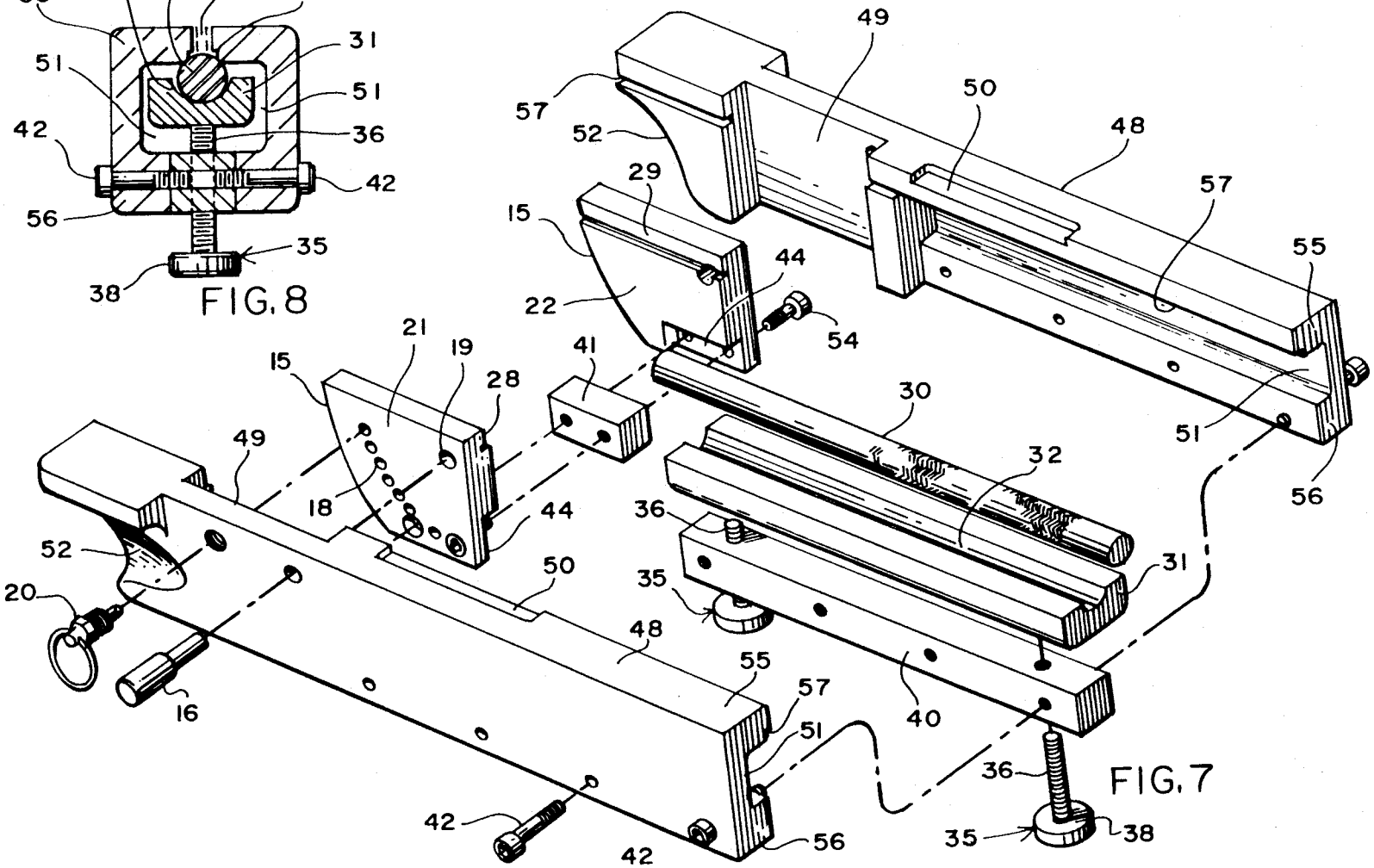
Figure 8:
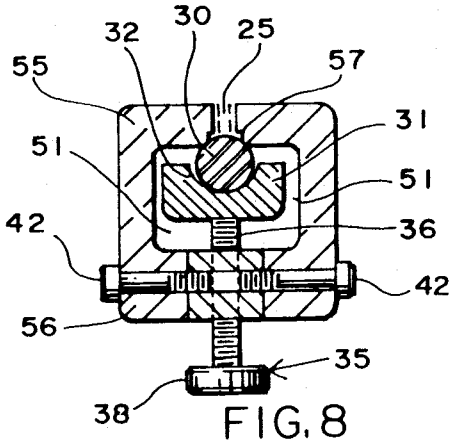

FIG. 7, an exploded perspective view, discloses the means interiorly of the unit for positioning the various abrading members in place the pivot and the shims; and FIG. 8 is similar to FIG. 3 but illustrates the insertion of a further shim in order to accommodate a larger or wider blade than that shown in FIG. 3.

DESCRIPTION OF A PREFERRED EMBODIMENT

The utilization of the skate sharpener will be appreciated beginning with a view of FIG. 1. There it will be seen that an ice skate 1 has a shoe 2 with toe 3, heel 4, blade mount 5, shoe pad 6, blade post 7, blade grip 8, and a blade 9. As shown, the skate is in an inverted orientation so that it can be easily positioned between the knees of the skater, and manipulated forwardly and rearwardly by the hand of the skater.

The sharpener 10, illustrated in greater detail in FIG. 2, includes a hand-held body member 11. The body of the hand member body 14 houses an adjustable pivot 15. The adjustable pivot 15 rotates partially about a pivot pin 16. A plurality of segmentally oriented pivot holes 18 are provided on the adjustable pivot 15 to selectively receive the pivot set pin 20. The pivot pin 16, as noted particularly in FIG. 7, passes through the pivot pin hole 19 in the set portion 21 and base portion set plate 22 of the adjustable pivot 15.

Again as shown in FIG. 2, the body is provided with a blade slot 25 running its entire length. There is also a blade slot 26 provided in the pivot 15. This is what permits the skate to be manipulated in a rotatable fashion irrespective of which portion of the skate blade 9 is being dressed by the file 30.

Turning now to FIGS. 3 and 8, it will be seen that provision is made for a file cradle bar 31 having a bar file groove 32 to underlie the blade slot 25. It is important that the bar file groove 32 have a cross-section and a radius as large as the largest file to be inserted so that when various shapes are employed as the file each one will be held in a precise central position. This occurs when the upper portion of the file engages the corner of the filing relief groove 57. The filing relief grooves 57 are provided to receive the swarf or filings which are developed as the skate is being sharpened against the file 30. A pair of cradle mounts 35 are provided in the lower portion of the hand-held body member 11 to bear on the underneath portion of the file cradle bar 31 to secure the file 30 physically against the lower portion of the blade slot 25. The cradle mount 35 includes a threaded shank 36, and a knurled knob 38 for physical manipulation by the skater to remove and change files to different diameter files, and to also rotate the file to present unworn areas when the file becomes worn.

As will be observed in noting the difference between FIGS. 3 and 8, the body sections are separated by means of a body shim 40. The pivot 15 has two sections which are separated by pivot shim 41. The pivot shim 41 rests in pivot shim recesses 44 provided in the set portion 21 and base set plate 22 of the pivot 15. When a wider skate blade as illustrated in FIG. 8 is being used, a wider body shim 40 and pivot shim 42 are secured in place by means of the body bolts 42, and the pivot shim bolt 54. As will be seen particularly in the upper portion of FIG. 7, the pivot set pin 20 is spring loaded so that it can be removed from the pivot set holes 18 in the pivot 15 to variously rotate the pivot about the pivot pin 16 to present the angled slot 26 of the pivot 15 in differing relationships to the entry guide recess 50 in the upper portion of the sharpener 10.

As observed in FIG. 4, the skate sharpener 10 is being reciprocated across the neutral zone 45 of the skate. In FIG. 5 it will be seen that the sharpener 10 is being manipulated along the turning zone 47 of the blade 9. Finally, in FIG. 6 it will be seen that the skate sharpener 10 is being reciprocated in order to sharpen the power zone 46.

Additional details are evident from the drawings such as the utilization of pivot shim bolts 54, and a blade slot runner 55 opposite the shim runner 56. The two runners of the opposite body members, when secured together, define the file cradle recess as best shown in FIGS. 3 and 8.

The method of sharpening comprises the steps of selecting a single body member having a skate slot at its upper portion and a circular abrading member such as a rat tail file mounted underneath it. A pivotal action is imparted to the blade by means of a pivotal member secured to the body member which is manipulated into varying angular relationships between the pivot blade guide and the body blade guide. The skater then sharpens his skate by reciprocating the same in three general areas, the central neutral zone, the rear turning zone, and the forward power zone. Optionally the blade may be addressed by two or more files, for example, if the neutral zone file is removed and a different file inserted for dressing the power zone and the turning zone. The foregoing steps permit the skater to predetermine to a large degree the blade profile best suited for him and to observe the pivot mount orientation best suited for is particular skate and file and commit the same to memory or otherwise record it so that repetitively the skate can be sharpened to the optimum empirically determined configuration.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A skate sharpener comprising, in combination, a hand-held body member, said hand-held body member housing an adjustable pivot member, a blade slot in said hand-held body member, a cradle beneath said blade slot for removably securing an abrading member beneath the blade slot of the hand-held member, a blade slot in the adjustable pivot member, and means for adjusting the pivot member pivotally within the hand-held body member to thereby vary the angular setting of the relationship between the blade slot of the pivot member and the blade slot of the hand-held body member.

2. In the blade sharpener of claim 1, said hand-held body member and said pivot member being comprised of two halves essentially in parallel fashion opposing each other to define the respective blade slots, and longitudinal shim means for insertion between both members to vary the width of their respective blade slots.

3. In the blade sharpener of claim 1, a pair of opposed filling relief grooves provided in the lower portion of the blade slot of the hand-held body member for receiving any filings as the blade is being dressed by the abrading member.

4. In the blade sharpener of claim 1, a plurality of arcuately spaced holds in the adjustable pivot member, and means coacting with the hand-held body member to engage a preselected hole to thereby fix the angle of the pivot member with respect to the hand-held body member.

5. In the blade sharpener of claim 1, said hand-held body member being made of two sides, said adjustable pivot member being made of two sides, and means for removably securing the two sides of the hand-held body member and the adjustable pivot member, and shims for positioning between the respective halves, whereby the blade slots in the respective hand-held body member and adjustable pivot member can be made larger or smaller depending upon the intended blade to be sharpened.

* * * * *